United States Patent [19]

Yeater

[11] 4,052,133

[45] Oct. 4, 1977

[54] CORROSION AND ABRASION RESISTANT CENTRIFUGAL PUMP

[75] Inventor: Tommy W. Yeater, Mansfield, Ohio

[73] Assignee: The Gorman-Rupp Company, Mansfield, Ohio

[21] Appl. No.: 631,216

[22] Filed: Nov. 12, 1975

[51] Int. Cl.[2] ..... F04D 7/06

[52] U.S. Cl. ..... 415/200; 415/53 R; 415/197; 415/214

[58] Field of Search ..... 415/53, 200, 197, 198, 415/214

[56] References Cited

U.S. PATENT DOCUMENTS

| | | | |
|---|---|---|---|
| 2,041,586 | 5/1936 | Brazen | 415/53 |
| 2,181,792 | 11/1939 | Rupp et al. | 415/53 |
| 2,627,817 | 2/1953 | Mann et al. | 415/53 |
| 2,741,991 | 4/1956 | Disbrow | 415/53 |
| 2,764,099 | 9/1956 | Wernert | 415/200 |
| 3,091,182 | 5/1963 | Anderson et al. | 415/197 |
| 3,752,603 | 8/1973 | Bunch | 415/200 |
| 3,776,659 | 12/1973 | Coon, Jr. | 415/214 |
| 3,826,589 | 7/1974 | Frank et al. | 415/214 |
| 3,876,327 | 4/1975 | Lobaroff | 415/214 |
| 3,914,072 | 10/1975 | Rowley et al. | 415/214 |

FOREIGN PATENT DOCUMENTS

| | | | |
|---|---|---|---|
| 558,841 | 1/1944 | United Kingdom | 415/53 |

*Primary Examiner*—C. J. Husar

*Attorney, Agent, or Firm*—Watts, Hoffmann, Fisher & Heinke Co.

[57] ABSTRACT

A self-priming centrifugal pump is disclosed in which major structural components of the pump housing are constructed from molded reinforced corrosion resistant plastic material. Internal parts of the pump housing which are subject to corrosion and abrasion from pumped liquids are formed using corrosion resistant metal and are permanently affixed to certain of the plastic pump housing components. The plastic components are reinforced against distortion resulting from pressure forces acting on them. Parts of the pump housing are detachably connected by clamping structure to permit replacement or repair of the pump impeller without requiring formation of load bearing threads in the plastic pump housing parts.

16 Claims, 4 Drawing Figures

CORROSION AND ABRASION RESISTANT CENTRIFUGAL PUMP

BACKGROUND OF THE INVENTION

1. Field of the Invention

The present invention relates to centrifugal pumps and more particularly relates to centrifugal pumps having housings formed by nonmetallic, corrosion resistant materials.

2. Prior Art

Pumps constructed from nonmetallic, corrosion resistant materials, notably plastics or fiber reinforced plastic (FRP) materials, are generally known in the prior art and have been constructed principally to reduce the cost of pumps used in applications where highly corrosive fluent materials are pumped. Pumps constructed from plastic materials have been used as alternatives to pumps constructed from substantially more expensive materials, such as stainless steel, to handle fluent materials which are chemically active. Examples of these substances are acidic or alkaline liquids used in various industrial processes such as metal treating, washing, etc.

Typical plastic pump constructions have been highly resistant to corrosion and deterioration as a result of exposure to chemically active pumped liquids but in some environments the pumped liquids have contained abrasive particulate matter which, when entrained in the pumped fluid, has tended to quickly erode the plastic material at locations in the pump where flow rates and velocities are high. Centrifugal pumps constructed from plastic materials have been particularly susceptible to erosion at the pump cutwater and along radial surfaces extending from the impeller eyes to volute walls extending about the impellers. In this type of environment pumps constructed from stainless steel have continued to be employed since stainless steel exhibits good corrosion and wear resistance. Stainless steel pumps are quite expensive and for that reason have been undesirable, notwithstanding their advantageous physical properties.

While plastic pump construction materials are fairly rugged and durable, they have been subject to relatively significant flexure when subjected to substantial pressure differentials. In particular, pump housings formed by assemblies of molded plastic parts have been subject to flexural stresses which distort the parts of the assemblies which has resulted in adjacent housing parts tending to separate. The plastic pump housing parts have also generally exhibited relatively low hoop strengths which has resulted in the peripheral regions of housing members tending to expand when subjected to differential pressure forces. Flexure of the plastic housing material has resulted in a tendency for these pump housings to leak during operation of the pumps. When corrosive or toxic fluids were being handled any such leakage was quite undesirable.

In order to minimize the effects of bending and hoop stresses on the plastic pump parts a number of measures have been proposed for strengthening or reinforcing the plastic pumps. In some instances the plastic parts have been reinforced by metal backing plates or specialized multipart clamping assemblies which were secured to the pump housings, or by the use of relatively large numbers of individual fasteners, or combinations of these expedients. Other approaches have suggested employing relatively heavy and/or specially-shaped housing wall sections (including molded in webs, ribs, bosses, etc). In general these approaches tended to complicate the pump constructions, thus increasing the complexity of manufacture and their cost as well as complicating maintenance and servicing of the pumps in the field.

Where plastic walls were specially formed to provide reinforcing structures such as heavy wall sections, webs, bosses, ribs, etc., and/or specially formed joints between assembly parts, the molded plastic parts were costly to fabricate. The molding apparatus for producing such parts was complex and expensive. For example, a molding technique used in constructing many prior art plastic pumps employed heated, matched metal molds in which the pump housing sections were formed.

Manufacturing some pumps required that a number of plastic housing parts be placed in jigs or fixtures in appropriate relative orientations and then secured together by fasteners, multipart clamping assemblies and the like. This was sometimes a tedious and time-consuming operation, particularly where the proper relative orientation of the pump parts was difficult to perceive. Furthermore, when a pump in the field required servicing, to the extent the pump could be disassembled for replacement or repair of internal parts, reassembly of the pump was frequently a difficult task.

Plastic or FRP pump housing members were sometimes provided with openings having molded or tapped threads for receiving threaded fasteners. The molded or tapped threads tended to strip when the housing members distorted under pressure. Stripped housing threads frequently lead to separation of pump housing parts during use of the pump and consequent leakage. To avoid the problem, tapped metal sleeves have been molded into the walls of the plastic pump housing members but the sleeves further complicated the pump fabrication processes and/or assembly procedures.

Summary of the Invention

The present invention provides a new and improved centrifugal pump constructed primarily from plastic component parts wherein internal portions of the pump are constructred to resist corrosion and abrasion from pumped liquids, which is inexpensively and easily produced and assembled, and which strongly resists distortion of the plastic parts caused by applied differential fluid pressure.

According to one important feature of the invention, a centrifugal pump is constructed using corrosion resistant plastic pump housing components and in which portions of the pump which are subjected to abrasion from pumped liquid are formed to include a corrosion and abrasion resistant material. Chemically active liquids containing abrasive materials impinge on the corrosion and abrasion resistant portions at high velocities but do not cause excessive wearing away of the portions compared to other parts of the pump.

In one preferred construction of a pump embodying the invention a pumping chamber is defined by molded plastic members which are bonded together to form an assembly with a corrosion and abrasion resistant metal tongue-like cutwater forming member fixed to the assembly. The cutwater forming member may be constructed from stainless steel or other suitable materials which remain relatively unaffected by impingement of high velocity chemically active and/or abrasive liquids over relatively long periods of pump use.

The preferred construction may also include an abrasion and corrosion resistant metal wear plate member forming a permanent part of the pump assembly.

Another feature of the invention resides in a centrifugal pump constructed in part by molded plastic components forming a pumping chamber and wherein the plastic components include cooperating engagement surfaces which assure assembly of the components in proper relative orientation and, after assembly, strengthen the pump against deformation caused by pumped fluid pressure forces.

Another feature of the new pump resides in the use of detachable fasteners which are effective to clamp plastic pump housing components together without necessitating tapping threads in plastic components or the use of threaded inserts in walls of the plastic components and yet permit easy disassembly of the pump to the extent necessary to repair or replace the pump impeller.

Still another feature of the invention resides in the construction of a self-priming centrifugal pump including a pumping chamber forming assembly formed partly by molded plastic components, a molded plastic hopper member bonded to the assembly and a simple, integral reinforcing structure extending about the pump and overlying the juncture of the hopper member and the pumping chamber assembly to reinforce the pump against flexure resulting from pressure forces exerted on the pump components. In the preferred pump, the reinforcing structure includes fibrous woven material bonded in place about the pump with fibers of the material extending across the juncture of the hopper member and the pumping chamber assembly. This construction strongly resists separation of the hopper member and the pumping chamber assembly along the juncture due to the pressure of pumped liquid acting on them. A length of filamentary material is helically wound about the pump and overlies the woven material. The helix formed by the filamentary material extends across the juncture of the pumping chamber assembly and the hopper member and is bonded in place to the pump. The filamentary material reinforces the pump against flexure caused by the hoop stresses produced in the plastic components when liquid is being pumped.

Other features and advantages of the invention will become apparent from the following detailed description of a preferred embodiment of the invention made with reference to the accompanying drawings.

DESCRIPTION OF A PREFERRED EMBODIMENT

Figure 1:
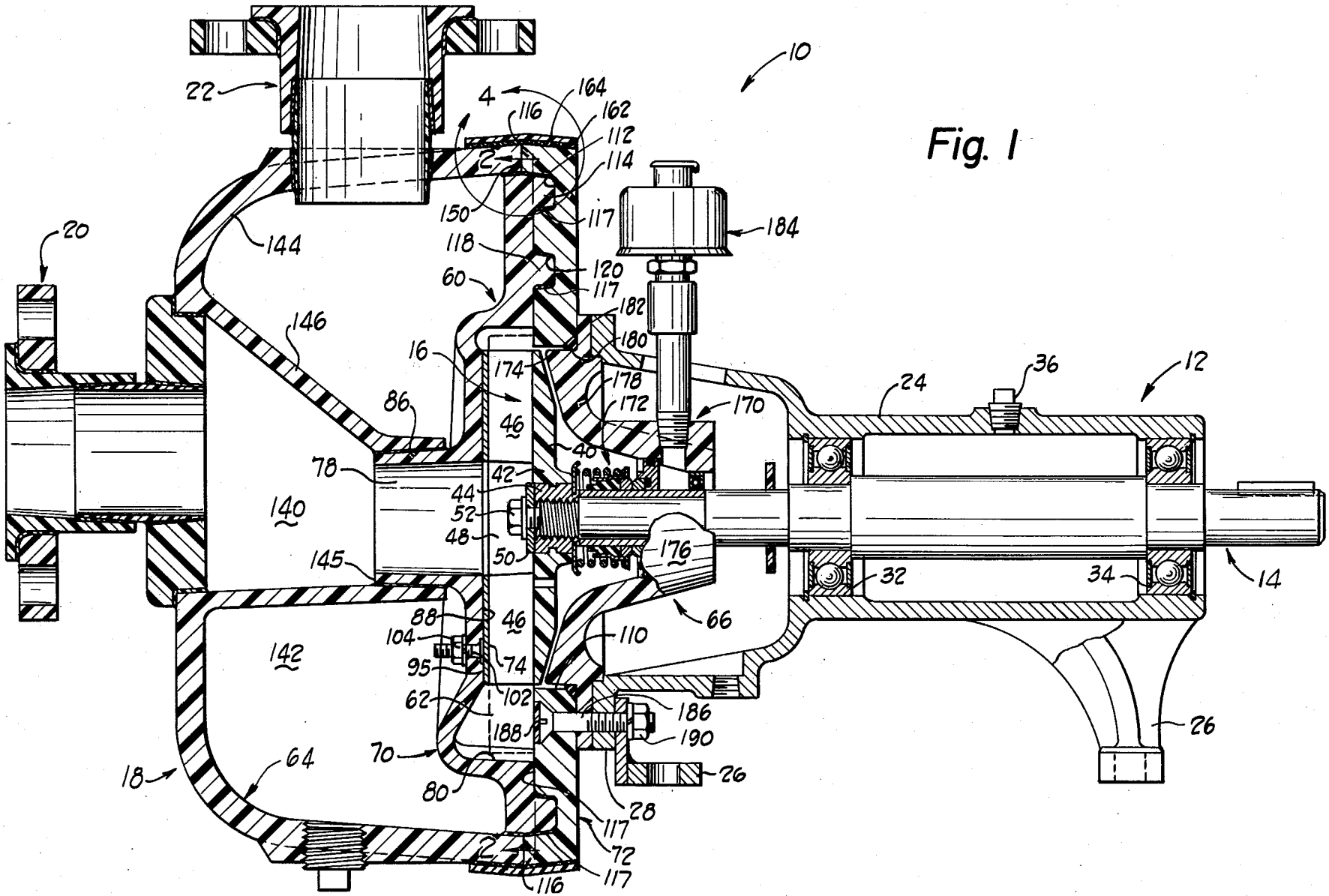
FIG. 1 is a cross-sectional view of a centrifugal pump embodying the present invention.

A self-priming centrifugal pump 10 constructed according to the present invention is illustrated in FIG. 1 of the drawings. The pump 10 includes a supporting base, or pedestal, 12, a drive shaft 14 supported by the pedestal and to which an impeller 16 is connected, and a pump housing assembly 18 disposed about the impeller 16. Intake and discharge flange structures 20, 22, respectively, are connected to and communicate with the pump housing assembly 18.

The illustrated pump is particularly well adapted for pumping chemically active (corrosive) liquids containing particulate matter which tends to abrade internal parts of the pump. The pump 10 is driven by a suitable motor or engine (not illustrated) and when the pump is driven liquid is drawn into the pump housing 18 via the intake flange structure 20 and is discharged from the housing 18 via the discharge flange structure 22. When the pump 10 is installed for use the flange structures 20, 22 are attached to suitably constructed liquid conduits which are not illustrated.

The pedestal 12 is formed from cast iron or some other suitable structurally strong material and includes a tubular body 24 having attached support legs 26 and a mounting flange 28 to which the pump housing assembly 18 is connected. The drive shaft 14 extends through the body 24 and is supported by spaced bearing assemblies 32, 34 which are anchored in the body. The bearing assemblies are suitably sealed to provide a lubricant chamber between them which is accessible from the outside of the body member 24 via a suitable vent plug 36. One end of the shaft projects from the body member 24 away from the pump housing assembly 18 and is provided with a keyway and key by which drive is transmitted to the shaft. The opposite end of the shaft 14 projects into the pump housing assembly 18 and is drivingly connected to the impeller 16.

The illustrated impeller 16 is formed by a molded plastic material, for example a polyester plastic, which may or may not be reinforced. The illustrated impeller is of generally conventional form in that it includes a circular disc-like impeller body 40 having a central hub 42 and a plurality of radially extending impeller blades 46 which project axially from the face of the impeller body 40. The blades 46 extend from the eye 48 to the outer periphery of the impeller body 40. The hub 42 is detachably connected to the shaft 14 and includes a molded-in supporting ring 44 which is threaded onto the shaft. The impeller is locked in place on the shaft by a clamping ring 50 which is forced against the impeller by a screw and lock washer assembly 52.

The housing assembly 18 is formed by a pumping chamber assembly 60 which defines a volute-shaped pumping chamber 62 (see FIGS. 1 and 2) extending about the impeller 16, a hopper member 64 attached to the assembly 60 for communicating the pumping chamber 62 with the intake and discharge flange structures 20, 22, and a sealing assembly 66 extending between the shaft 14 and the assembly 60 on the axial side of the impeller opposite the hopper member 64.

The assembly 60 is disposed about the impeller and functions to guide intake liquid into the pumping chamber 62 from the intake flange structure 20 via the hopper member 64, direct pumped discharge liquid from the pumping chamber 62 to the discharge flange structure 22 via the hopper member, and to enable priming of the pump. The assembly 60 is formed by a scroll plate member 70, a scroll cover member 72, a wear plate 74 and a cutwater 76 (see FIGS. 2 and 3). The scroll member 70 and the scroll cover member 72 are each formed of molded corrosion-resistant plastic material and are bonded together to form an integral unit providing an impeller intake passage 78, a priming passage 80 (see FIG. 2) and a discharge passage 82 all of which communicate the pumping chamber 62 with the interior of the hopper member 64.

Figure 2:
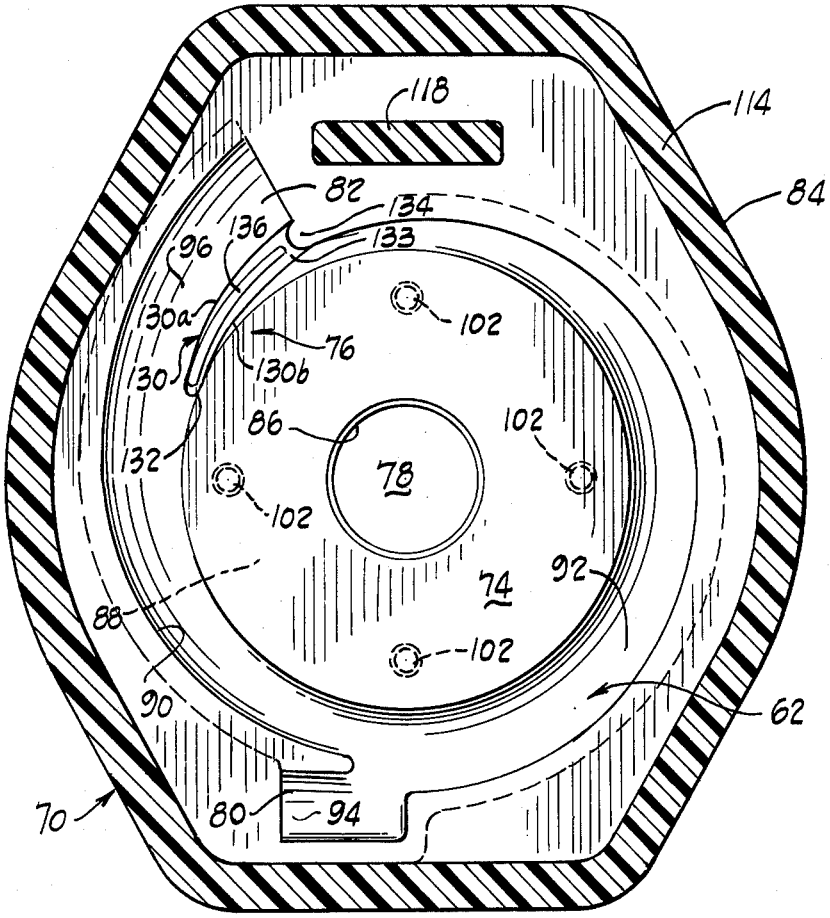
FIG. 2 is a view seen approximately from the plane indicated by the lines 2—2 of FIG. 1.
Figure 3:
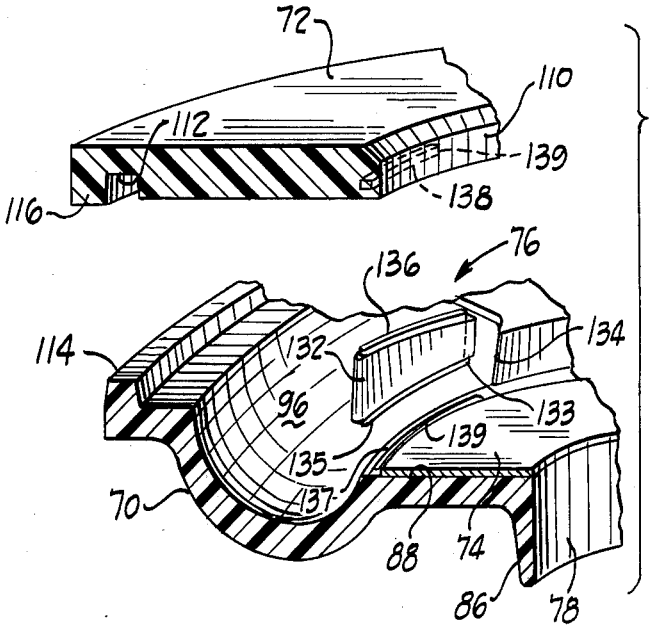
FIG. 3 is an exploded perspective view of parts of the pump illustrated in FIG. 1 with portions shown in cross-section; and, FIG. 4 is an enlarged cross-sectional view taken within the line 4 of FIG. 1.

Referring to FIG. 2, the illustrated scroll member has a polygonal outer periphery 84 and a central hub 86 surrounding the intake passage 78. A planar circular wall portion 88 extends radially from the hub 86 and a recessed pumping chamber wall portion 90 extends about the circular wall portion 88. The recessed wall portion 90 forms a scroll, or volute-shaped, section 92 and continuous priming and discharge passage wall sections 94, 96, respectively.

The wear plate 74 is fixed to the scroll member 70 and is disposed immediately adjacent the projecting edges of the impeller blades 46. The wear plate is a flat annular member formed of abrasion and corrosion resistant material, such as stainless steel, and is attached to the scroll member wall portion 88. In the illustrated embodiment of the invention, the wear plate is permanently affixed to the wall portion 88 by bonding material disposed between them (indicated by the reference character 95, FIG. 1). Threaded studs 102 are welded to the wear plate and extend through aligned openings in the wall portion 88 for receiving nut and lock washer assemblies 104 which are threaded against the wall portion 88 to clamp the wear plate to the wall portion.

As the name implies the scroll cover member 72 covers the recessed wall portion 90 of the scroll member and substantially completes the formation of the scroll or volute-shaped chamber and the discharge and priming passages. The scroll cover member 72 is a generally plate-like structure having a polygonal outer periphery and a circular impeller access opening 110 extending closely about the periphery of the impeller 16.

The outer periphery of the scroll cover member is constructed and arranged to interfit with the periphery of the scroll member 70 for facilitating bonding the scroll and scroll cover members together. A peripherally extending polygonal recess 112 in the scroll cover member conforms with and receives a projecting peripheral lip 114 formed on the scroll member 70. The outer wall of the recess 112 defines an axially projecting continuous peripheral lip 116 which surrounds the lip 114 and projects axially away from the scroll cover member. A bonding material, indicated by the reference character 117, is disposed between the lip 114 and the recess 112 as well as between confronting radial faces of the scroll and scroll cover members to permanently secure them together.

The scroll and scroll cover members are constructed so that they can be assembled only when in their proper relative orientation. A locating, or guide, projection 118 is formed on the scroll member and when the scroll and scroll cover member are assembled the projection 118 extends into a conforming recess 120 formed in the scroll cover member. This structure assures proper orientation of the scroll and scroll cover members as they are assembled. The bonding material 117 is disposed in the recess 120 so that after assembly the projection 118 is bonded in place in the recess 120.

The cutwater 76 (see FIGS. 2 and 3) is, in the illustrated embodiment of the invention, formed by a corrosion and abrasion resistant tongue-like part 130 which is disposed along the discharge passage and extends tangentially away from the volute chamber. The outer major surface 130*a* of the cutwater part forms a portion of the inner wall of the discharge passage along which high velocity discharge liquid flows which the opposed major surface 130*b* forms a portion of the volute-shaped pumping chamber 62. In the illustrated and preferred embodiment the tongue-like part is formed by a stainless steel member having a projecting tip 132 disposed adjacent the impeller periphery and an opposed base 133 which is nested with a conforming seat 134 formed on the scroll plate member.

The part 130 is permanently secured between the scroll and scroll cover members and to this end is provided with projecting locating lands 135, 136 which extend along opposite sides of the part 130. The lands 135, 136 project into respective conforming grooves 137, 138 which are formed in he scroll and scroll cover members, respectively, and bonding material (indicated by the reference character 139) in the grooves maintains the part 130 permanently in place. The bonding material 139 is also disposed between the base 133 and the seat 134 to assure a liquid tight seal between the base and the seat as well as to further anchor the part 130 in position.

If desired, the cutwater 76 can be formed by a part molded integrally with the scroll member 70 and provided with a corrosion and abrasion resistant filler material, such as tungsten carbide particles, which is molded into the part during formation of the scroll member. In such a construction the cutwater part is bonded along its free edge to the scroll cover member 72.

The hopper member 64 is constructed to provide an intake passageway 140 extending between the intake flange structure 20 and the scroll plate intake passage 78 and a hopper chamber 142 communicating the discharge and priming passages 82, 80 with the discharge flange structure 22. The hopper member 64 is bonded to the pumping chamber assembly 60 and is a generally concave body formed by an outer peripheral wall 144 and a central generally frustoconical tubular wall section 146. The walls 144, 146 bound the hopper chamber 142 and the rubular wall section 146 forms the intake passageway 140. As best illustrated in FIG. 1, the tubular hopper wall section 146 is permanenntly attached to the scroll plate hub 86 by bonding material, indicated by the reference character 145, so that liquid directed into the pumping chamber via the intake passageway 140 is isolated from fluid in the hopper chamber 142.

The hopper wall 144 is permanently secured to the pumping chamber assembly 60 and in the illustrated embodiment the wall 144 defines a peripheral polygonal lip 150 which is configured to engage the scroll cover lip 116. The lips 116, 150 each define a locating face and the locating faces extend adjacent each other when the hopper member 64 is assembled on the assembly 60. The outer periphery of the scroll plate member 70 extends within and adjacent the lips 116, 150 to form a locating shoulder for the hopper lip 150. The hopper lip 150 is bonded to both the scroll cover member 72 and the scroll member 70 by the bonding material 117 to provide a high strength connection between the hopper member 64 and the assembly 60.

When the pump 10 is operating the pumping chamber 62 is filled with pumped liquid and the hopper chamber 142 is filled with pumped liquid at the pump discharge pressure. The pressure of the liquid in the pumping chamber 62 produces pressure forces on the scroll and scroll cover members which tend to, in effect, "peel" them apart. These forces are resisted by the bonded lips 114, 116. As best seen in FIG. 1, the lips 114, 116 are spaced radially away from the chamber 62 a maximum distance adjacent the pump discharge passage 82. The lips 114, 116 would be least able to resist the "peeling" forces adjacent the discharge passage 82 because of the relatively large effective lever arm between the lips and the discharge passage; however, the projection 118, bonded in place in the recess 120, supplements the resistive property of the lips 114, 116 and thus reinforces the assembly 60 against "peeling" type failures. If desired, multiple locating projections and conforming recesses can be provided for the dual purpose of facilitating the pump assembly and reinforcing the pump housing.

The pressure forces which are exerted on the pump housing as a consequence of the pumped liquid in the hopper chamber tend to axially separate the hopper member from the assembly 60 along their juncture. Additionally, the internal pressure forces exerted on the hopper member 64 give rise to substantial hoop stresses in the hopper member lip 150 which tend to expand its diametrical extent and cause separation of the lips 150, 116.

Figure 4:
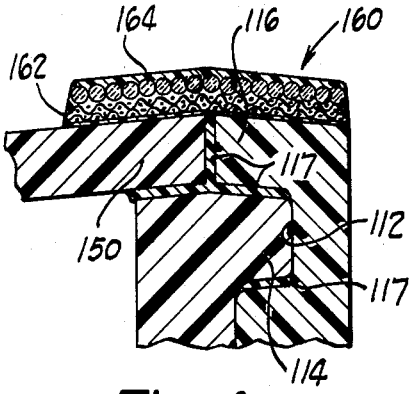

The juncture of the assembly 60 and the hopper member 64 is reinforced against deformation which could be caused by hopper member hoop stresses as well as against axial separation of the hopper member and the assembly 60 by a simple, strong, corrosion-resistant reinforcing structure 160 (see FIG. 4). The reinforcing structure 160 is formed by bidirectionally-woven material 162 which extends about the circumference of the hopper lip 150 and the scroll cover lip 116 and bridges their juncture, a filamentary strand 164 would helically about the pump housing and overlying the woven material, and a bonding resin material which saturates the woven and filamentary materials to combine them into an integral reinforcing body which is unitary with pump housing. In the preferred embodiment, two to three layers of the woven material are disposed continuously about the housing assembly and the material is saturated with the resin material. The woven material is preferably formed by glass fibers which are cross-woven so that some fibers extend circumferentially around the housing while the remaining fibers extend across the juncture of the lips 116, 150. The fibers provide both axial and circumferential strength to the housing at the juncture of the lips 116, 150. One suitable material is a two-inch wide glass tape having a "VOLAN" finish available from Owens Corning.

The strand 164 is preferably formed by glass fiber filaments and is helically would about the material 162 with the helix formed by the winding terminating at opposite sides of the juncture of the hopper lip 150 and the scroll cover lip 116. The strand 164 has a relatively high tensile strength and functions to rigidly reinforce the hopper lips against deformation caused by the hoop stresses. One suitable strand is Owens-Corning type 891 AA 675 glass filament with sizing.

In a preferred embodiment of the invention, the reinforcing structure 160 is applied to the pump housing assembly by placing the pump housing assembly on a rotatable mandrel and winding the cloth and the filament about the housing as the housing is rotated. The resin material may be applied as the cloth and the strand are wound onto the assembly. One suitable resin is a polyester isophthalic thermosetting resin available from Owens-Corning as No. E-704 which is used with an appropriate catalyst.

The sealing assembly 66 extends between the scroll cover plate 72 and the impeller shaft 14 to prevent leakage of liquid from the pumping chamber 62 and includes a seal plate 170, a shaft seal assembly 172 for preventing leakage of pumped fluid between the seal plate 170 and the shaft 14 and a static O-ring type seal 174, which is disposed between the seal plate and the scroll cover member.

The seal plate 170 is formed by a hub 176 which extends closely about the shaft 14 and a skirt portion 178 which extends radially from the hub to the scroll cover member. The skirt 178 defines a shoulder 180 which extends within the scroll cover member opening 110 and a peripheral flange 182 extending radially beyond the shoulder 180.

The O-ring seal 174 is compressed between the skirt 178 and the scroll cover member 72. The shaft seal assembly 72 may be of any suitable construction and is illustrated as a relatively rotatable face-type seal, a portion of which is supported by and rotatable with the shaft 14 and a portion of which is supported by the hub 176. The seal assembly is lubricated from a lubricant reservoir 184 supported by the hub 176.

The assembly 60, the seal plate 170 and the pedestal 12 are assembled in clamped detachable relationship by a plurality of screws 186 (only one of which is illustrated) which are bonded to the scroll cover member and extend through aligned openings in the scroll cover member 72, the seal plate flange 182 and the pedestal mounting flange 28. The heads of the screws are countersunk in the scroll cover member and are bonded in place to the scroll cover member by a bonding material indicated at 188. The bonding material completely surrounds the head of each screw and extends flush with the plane of the scroll cover member to lock the screw in place and seal the opening through which the shank of the screw extends from the scroll cover member. The ends of the screws project through the pedestal flnge 28 and receive nuts and lock washers indicated at 190.

The head of the screw 186 and the nut and lock washer assembly 190 provide opposed clamping surfaces so that when the nut and lock washer assembly is tightened down on the screw, the seal plate and pedestal flanges are compressively urged against the scroll cover member without requiring the plastic material forming the scroll cover member and the seal plate to be provided with threaded openings. The seal plate 170 can be readily disassembled from the pump housing to permit repair or replacement of the pump impeller and the seals.

In the preferred and illustrated embodiment, the hopper member 64, the scroll plate member 70, the scroll cover member 72 and the seal plate 170 are all formed of plastic material, preferably fiber reinforced polyester plastic, or a fiber reinforced epoxy, and are separately formed by a so-called cols molding process. This process does not require injection of plastic material into a mold cavity, nor does it require the use of matched heated metal molds. The molds themselves can be made from plastic material and the molded plastic pump housing parts can thus be manufactured easily without requiring large expenditures for obtaining complex and/or high precision molds and associated equipment.

In the illustrated and preferred embodiment the intake and discharge flange structures are of generally conventional formation with each of the elements of these structures being formed by a fiber reinforced, molded plastic material like the material used for construction of the pump housing components. The elements of the flange structures are bonded to each other and the flange structures are each bonded to the hopper member 64.

In all instances the material used for bonding the various components together is a suitable polyester or epoxy base adhesive having an appropriate filler material. One such material which has been found effective is an epoxy base casting compound known as HYOL No. C-94183 available from the Dexter Corporation, Olean, N.Y., which is used with a hardener H-23561 and a glass filler material known as "CAB-O-SIL" M-5 available from Cabot Coporation.

While a single embodiment of the present invention has been illustrated and described in considerable detail the present invention is not to be considered limited to the precise construction shown. Various adaptations, modifications and uses of the invention may occur to those skilled in the art to which the invention relates and the intention is to cover all such adaptations, modifications and uses which come within the spirit or scope of the appended claims.

What is claimed is:

1. A centrifugal pump comprising:
a. an impeller;
b. first and second molded nonmetallic, corrosion resistant, pumping chamber defining members;
c. one of said first and second members defining a volute wall portion bounding said chamber;
d. said impeller supported for rotation about an axis extending through said members and disposed in the chamber defined by said first and second members;
e. a cutwater between said first and second members and extending from said volute wall portion, said cutwater composed, at least in part, of a corrosion and wear resistant material; and,
f. means for connecting said cutwater to one of said first and second members, said connecting means comprising a bonding material between said cutwater and said one member;
g. one of said cutwater and one of said members including a projecting land portion and the other of said cutwater and said one member defining a groove conforming to and receiving said land portion, said bonding material disposed at least in part between said projecting land portion and said groove.

2. A pump as claimed in claim 1 wherein said cutwater is formed at least in part by a metallic corrosion and abrasion resistant material, said cutwater defining a tip portion adjacent the periphery of said impeller and a base portion engaging a seat formed by one of said first and second members.

3. A pump as claimed in claim 2 wherein said cutwater is composed of stainless steel.

4. A centrifugal pump comprising:
a. an impeller;
b. first and second molded nonmetallic, corrosion resistant, pumping chamber defining members;
c. one of said first and second members defining a volute wall portion bounding sand chamber;
d. said impeller supported for rotation about an axis extending through said members and disposed in the chamber defined by said first and second members;
e. a cutwater between said first and second members and extending from said volute wall portion, said cutwater composed, at least in part, of a corrosion and wear resistant material and,
f. means for connecting said cutwater to one of said first and second members, said connecting means comprising a bonding material between said cutwater and said one member;
g. said cutwater formed by a tongue-like corrosion and abrasion resistant member disposed between said first and second members, said cutwater member including lands extending along its opposite sides and said first and second members defining grooves conforming to said lands and into which said lands project for locating said cutwater relative to said first and second members.

5. A centrifugal pump comprising:
a. a corrosion resistant impeller member;
b. first and second molded nonmetallic, corrosion resistant, pumping chamber defining members;
c. one of said first and second members defining a volute wall portion bounding said chamber;
d. said impeller supported for rotation about an axis extending through said members and disposed in the chamber defined by said first and second members;
e. a cutwater member between said first and second members including a base seated against one of said first and second members and a tip portion disposed adjacent the periphery of said impeller projections extending along opposite sides of said cutwater members between said base and said tip portion, and a projection receiving recess formed in each said first and second member into which a respective projection extends.

6. The pump claimed in claim 5 wherein said connecting means further comprises bonding material for securing said projections in said recesses.

7. A self-priming centrifugal pump comprising:
a. a molded nonmetallic, corrosion resistant, hopper member;
b. first and second molded nonmetallic, corrosion resistant members defining a pumping chamber, said chamber having a priming opening, a discharge opening, and an intake opening;
c. an impeller disposed in the chamber for rotation about an axis;
d. said first and second members defining confronting adjacent wall portions extending radially outwardly from said impeller, one of said first and second members defining an alignment guide portion projecting into a recess portion of said other member when said first and second members are assembled in proper orientation with respect to each other;
e. one of said first and second members defining a locating face disposed radially outwardly from said impeller and extending circumferentially about said impeller, said locating face disposed adjacent a coextending second locating face on said hopper member; and,
f. connecting means for bonding said first and second members together and bonding said hopper member to said at least one of said first and second members with said locating faces disposed adjacent and bonded to each other and said alignment guide portion bonded to said recess portion.

8. A pump as claimed in claim 7 wherein said locating face on said one of first and second members is formed by a circumferentially extending member lip disposed at least partially about the periphery of said other of said first and second members, said second locating face on said hopper member formed by a hopper lip which is disposed at least partially about and adjacent the periphery of said other of said first and second members, and said connecting means including structure for bonding said hopper lip to said other of said first and second members.

9. The pump claimed in claim 8 wherein said connecting means further includes reinforcing structure disposed circumferentially about the juncture of said locating faces and bridging said faces.

10. The pump claimed in claim 9 wherein said reinforcing structure comprises a fibrous material having fibers oriented for bridging said juncture of said locating faces and bonding material for securing said fibers to said hopper member and said one of said first and second members.

11. The pump claimed in claim 10 wherein said reinforcing structure further comprises a strand of filamentary material disposed in a helix about said pump and overlying said fibrous material, said helix bonded to said fibrous material.

12. A self-priming centrifugal pump comprising:

a. a molded nonmetallic, corrosion resistant, hopper member;

b. a nonmetallic, corrosion resistant assembly defining a pumping chamber, said assembly defining a priming opening, a discharge opening and an intake opening;

c. an impeller disposed in the pumping chamber for rotation about an axis;

d. said hopper member and said assembly defining adjacent confronting surfaces extending peripherally about the pump; and, e. connecting means between said assembly and said hopper member comprising:

i. a woven fibrous material disposed about said pump and including fibers extending across the juncture of said hopper member and said assembly;

ii. means for bonding said woven material to said hopper member and said assembly;

iii. a strand of filamentary material, disposed helically about said pump, the helix defined by said filamentary material overlying said woven material;

iv. means for bonding said filamentary material in place about said pump.

13. The pump claimed in claim 12 wherein said woven material is formed by bidirectionally-woven glass fibers.

14. The pump claimed in claim 12 wherein said strand of filamentary material is formed at least in part by glass fiber filaments.

15. A centrifugal pump comprising:

a. a supporting body member;

b. a driving shaft and bearings supported by said body member;

c. a corrosion resistant impeller detachably connected to said shaft and rotatable with said shaft about an axis;

d. a pumping chamber assembly comprising first and second plastic members, said first member defining an impeller intake passage opening substantially on said axis at one axial side of said impeller with said first member extending from said passage radially beyond said impeller, one of said members defining at least part of a volute wall extending about said impeller, said second member bonded to said first member with said first and second members defining walls of a discharge passage and said second member defining an access opening having a periphery extending about said impeller and through which said impeller is removable;

e. a sealing assembly comprising a third plastic member having a hub disposed about said shaft and a radially outwardly extending skirt portion extending adjacent one of said first and second members, seal means between said skirt portion and said one of said first and second members, and second seal means between said shaft and said third member hub; and f. connecting means for detachably connecting said third member, said one of said first and second members, and said supporting body member, said connecting means comprising opposed clamping surfaces for compressively urging said members together.

16. The pump claimed in claim 15 wherein one clamping surface is formed on a threaded member which is bonded to said one of said first and second members, said threaded member extending through openings in said one member, said third member and said supporting body member, and an opposed clamping surface is associated with an element threaded to said threaded member.

* * * * *